US010883327B1

(12) United States Patent
Drury et al.

(10) Patent No.: US 10,883,327 B1
(45) Date of Patent: Jan. 5, 2021

(54) POWER CHARGE WITH EXPOSED PROPELLANT

(71) Applicant: DIAMONDBACK Industries, Inc., Crowley, TX (US)

(72) Inventors: Derrek D. Drury, Fort Worth, TX (US); Jimmy L. Carr, Fort Worth, TX (US); Robert C. Andres, Fort Worth, TX (US); Trea H. Baker, Granbury, TX (US)

(73) Assignee: DIAMONDBACK Industries, Inc., Crowley, TX (US)

( * ) Notice: Subject to any disclaimer, the term of this patent is extended or adjusted under 35 U.S.C. 154(b) by 0 days.

(21) Appl. No.: 15/947,749

(22) Filed: Apr. 6, 2018

Related U.S. Application Data

(63) Continuation-in-part of application No. 14/467,718, filed on Aug. 25, 2014, now Pat. No. 10,107,054.

(51) Int. Cl.

| | |
|---|---|
| ***E21B 23/00*** | (2006.01) |
| ***E21B 23/06*** | (2006.01) |
| ***E21B 23/04*** | (2006.01) |
| ***F42B 5/38*** | (2006.01) |
| ***F42B 3/04*** | (2006.01) |
| *F42B 5/192* | (2006.01) |
| *F42B 3/26* | (2006.01) |

(52) U.S. Cl.
CPC ..... *E21B 23/065* (2013.01); *E21B 23/04* (2013.01); *F42B 3/04* (2013.01); *F42B 5/38* (2013.01); *F42B 3/26* (2013.01); *F42B 5/192* (2013.01)

(58) Field of Classification Search
CPC ..... F42B 5/192; E21B 23/065
See application file for complete search history.

(56) References Cited

U.S. PATENT DOCUMENTS

| | | | | |
|---|---|---|---|---|
| 3,422,760 | A * | 1/1969 | Mohaupt | E21B 43/263 102/313 |
| 3,580,180 | A * | 5/1971 | Gawlick | F42B 1/00 102/285 |
| 4,064,935 | A * | 12/1977 | Mohaupt | E21B 43/263 102/313 |
| 4,530,396 | A * | 7/1985 | Mohaupt | E21B 43/263 102/313 |

(Continued)

*Primary Examiner* — Reginald S Tillman, Jr.
(74) *Attorney, Agent, or Firm* — Mark W Handley; Handley Law Firm, PLLC

(57) ABSTRACT

A power charge (12) for a setting tool is composed of a propellant (16) and an igniter (32) embedded in the propellant (16). The propellant (16) is a homogeneous mixture of combustible components, an oxidizer and an epoxy binder, which together provide a continuous mass of solid form. The propellant (16) has an exterior (14) which, together with an outward face (36) of the igniter (32), is exposed and provides the outer surface of the power charge (12). A protuberant rib (28) extends along the length of the exterior (14) in a spiral-shaped pattern and provides a stand-off spacer between the power charge (12) and the setting tool. The igniter (32) has a main body portion (52) and an annular-shaped protrusion (48) which extends laterally outward from the main body portion (52) and into the propellant (16) to retain the igniter (32) within the propellant (16). The entire power charge (12) is formed of combustible materials.

11 Claims, 2 Drawing Sheets

(56) References Cited

U.S. PATENT DOCUMENTS

| | | | | |
|---|---|---|---|---|
| 4,976,318 | A * | 12/1990 | Mohaupt | E21B 37/08 166/311 |
| 2006/0048664 | A1* | 3/2006 | Tiernan | F42D 1/04 102/332 |
| 2017/0138164 | A1* | 5/2017 | Mace | F23Q 21/00 |
| 2018/0163497 | A1* | 6/2018 | Younger | E21B 29/02 |
| 2018/0340390 | A1* | 11/2018 | Oag | B23K 7/006 |

* cited by examiner

POWER CHARGE WITH EXPOSED PROPELLANT

CROSS-REFERENCE TO RELATED APPLICATION

The present application is related to, as a continuation-in-part, U.S. Pat. No. 10,107,054, issued Oct. 23, 2018, having application Ser. No. 14/467,718, filed Aug. 14, 2014 and entitled "Power Charge Having Combustible Sleeve," which is related to U.S. Pat. No. 9,453,382, issued Sep. 27, 2017, filed Aug. 25, 2014, and entitled "Power Charge Igniter Having A Retainer Protrusion," both invented by Derrek D. Drury, Jimmy L. Can, Robert C. Andres, and Trea H. Baker, inventors of the present application, and assigned to Diamondback Industries, Inc., the assignee of the present application.

TECHNICAL FIELD OF THE INVENTION

The present invention relates in general to downhole oil tools, and more particularly to power charges used for operating downhole oil tools.

BACKGROUND OF THE INVENTION

Power charges or power cartridges are used in oil and gas well setting tools to provide power for setting downhole tools such as plugs, packers, cement retainers, and other devices in well casing. Power charges are constructed of propellant mixtures composed of carefully controlled combustible elements containing an oxidizer which when ignited will begin a slow burn lasting approximately thirty seconds. The gas derived from a burning power charge propellant mixture gradually builds up to high pressures and causes a setting tool to stroke, setting a downhole tool in a well. In conventional setting tools, the power charge is placed in a power charge chamber which also provides a combustion chamber. The power charge is burned and typically creates gas pressure from 7,000 psi to 13,000 psi. Typical prior art power charges were made by packing the propellant into a sleeve formed of plastic, fiberglass, steel, and more recently fiberboard. Some prior art power charges have a first end which is open and which exposes the combustible material to an igniter. Other power charges have an igniter embedded in the first end of the power charge.

Problems have been encountered when the fiberglass and the plastic sleeves are used as power charge housings. Burning the power charges will often create plastic debris which has blocked flow ports and caused the setting tools to fail to operate properly. Also, partially melted plastic residue will often line the sidewalls of the setting tool power charge combustion chamber and can be difficult to clean from the sidewalls. Steel tubes have also been used for power charge housings, but these also have difficulty. The steel tubes can deform when the flammable mixture of the power charge burns and be difficult to remove from power charge chambers of setting tools. Additionally, steel tubes, plastic tubes and fiberglass tubes can contain the gasses of the power charge mixture as it burns until high pressures build up within the housing, which can lead to an explosive discharge and the tubes being ejected as a projectile from a burning fire. This has resulted in the Department of Transportation classifying power charges as explosives when the power charges have outer housings provided by steel tubes, fiberglass tubes, and plastic tubes. Fiberboard tubes may also leave a residue from adhesives used in gluing layers of the fiberboard sleeve.

Some prior art power charges have an igniter located in one end, embedded in the propellant. Prior art power charges are typically cylindrical. Shipping and handling, variations in temperature, and shrinkage of propellant mixtures with variations in humidity can cause the igniter to become loose in the propellant mixture, with some having completely fallen out of the power charge. Although the power charge igniter may be pushed back into the propellant mixture by hand, the igniter will remain susceptible to being jostled and disconnecting from the power charge propellant material.

SUMMARY OF THE INVENTION

A power charge is disclosed for burning in a setting tool to power the setting of a downhole tool. The power charge is preferably composed of a propellant and an igniter which is embedded in the propellant. The propellant is a mixture of combustible components, an oxidizer and an epoxy binder, which are together cured to provide a continuous mass of solid form. The propellant has an exterior which, together with an outward face of the igniter, is exposed to provide the outer surface of the power charge. The propellant is preferably homogenous and includes one or more protuberant ribs which extend along the length of the exterior in a spiral-shaped pattern and provide a stand-off spacer between the power charge and setting tool housing. An igniter is disposed in the first end face, embedded into the propellant. The igniter has a main body portion which is cylindrically-shaped and disposed adjacent to the first end face of the power charge, and an annular-shaped protrusion extending laterally outward from the main body portion and into the propellant. The annular-shaped protrusion defines a shoulder which extends from the main body portion, spaced apart from the end face of the power charge, and engages the propellant to retain the igniter within the propellant in the first end face of the power charge. Since the power charge does not have an exterior sleeve which may leave a residue within a setting tool power charge chamber, setting tool cleanup is less cumbersome and redress time is reduced over that required for prior art power charges.

DESCRIPTION OF THE DRAWINGS

For a more complete understanding of the present invention and the advantages thereof, reference is now made to the following description taken in conjunction with the accompanying Drawings in which

FIG. 1 is a perspective view of the power charge having exposed propellant;

FIG. 2 is an end view of the power charge;

FIG. 3 is a longitudinal section view of the power charge, taken along section line 3-3 of FIG. 1;

FIG. 4 is an enlarged, partial section view of the power charge, taken along section line 3-3 of FIG. 1;

FIG. 5 is a perspective view of an igniter used in the power charge;

FIG. 6 is a sectional view of the igniter, taken along section line 6-6 of FIG. 5; and FIG. 7 is a longitudinal section view of a power charge being fabricated using a packing sleeve, as viewed along section line 3-3 of FIG. 1.

DETAILED DESCRIPTION OF THE INVENTION

The present application incorporates by reference as if fully set forth herein U.S. Pat. No. 9,453,382, issued Sep. 27, 2017, filed Aug. 25, 2014, and entitled "Power Charge Igniter Having A Retainer Protrusion," and U.S. Pat. No. 10,107,054, issued Oct. 23, 2018, having application Ser. No. 14/467,718, filed Aug. 14, 2014 and entitled "Power Charge Having Combustible Sleeve," which are both invented by Derrek D. Drury, Jimmy L. Carr, Robert C. Andres, and Trea H. Baker, inventors of the present application, and assigned to Diamondback Industries, Inc., the assignee of the present application.

Figure 1:
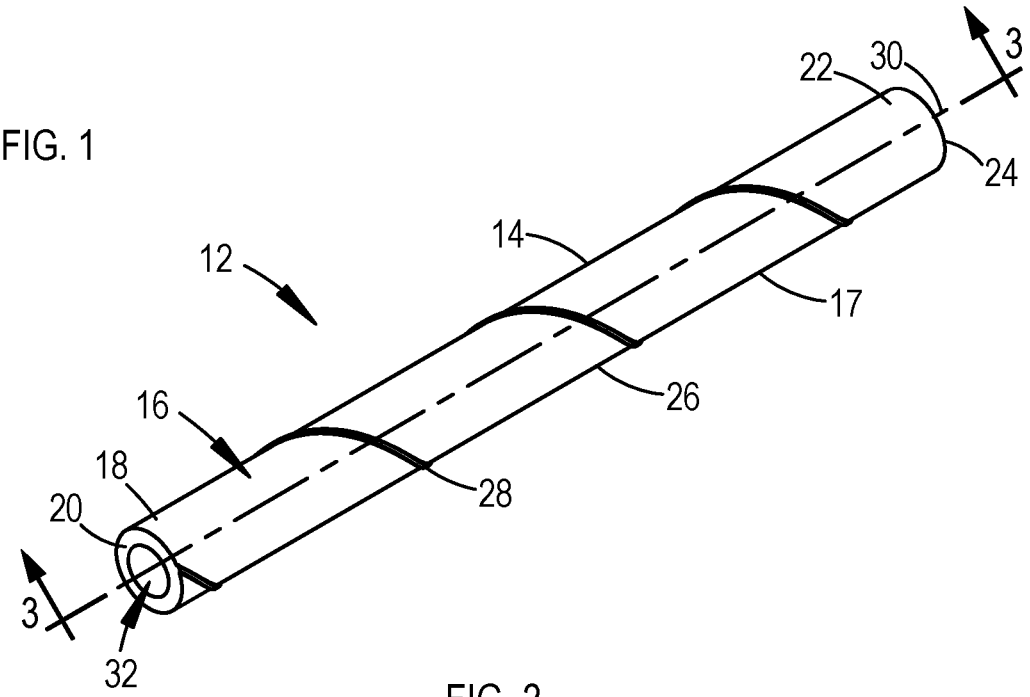
FIGS. 1 through 7 show various aspects for a power charge having exposed propellant according to the present invention, as set forth below.

FIG. 1 is a perspective view of a power charge 12 formed entirely of a propellant 16 and an igniter 32, with the exterior 14 of the propellant 16 being fully exposed. The power charge 12 has outer peripheral surfaces providing a periphery 26, which is preferably fully provided by an exposed exterior 14 of the propellant 16 and an exposed outward face 36 of the igniter 32. The exterior 14 of the propellant 16 and the outward face 26 of the igniter are fully and completely exposed since the are not covered by an exterior housing. The exterior 14 defines at least part of the periphery 26 of the power charge 12. The exterior 14 includes a lateral portion 17 which is a primary outwardly disposed portion having a generally uniform shape. Preferably, the generally uniform shape of the lateral portion 17 is a cylindrical shape which includes a length, a longitudinal axis 30 which extends parallel to the length, and a first end 18 and a second end 22 disposed at opposite ends of the length. The first end 18 and the second end 22 have end faces 20 and 24, respectively, spaced apart by the length of the lateral portion 17 and disposed perpendicular to the longitudinal axis 30.

Figure 4:
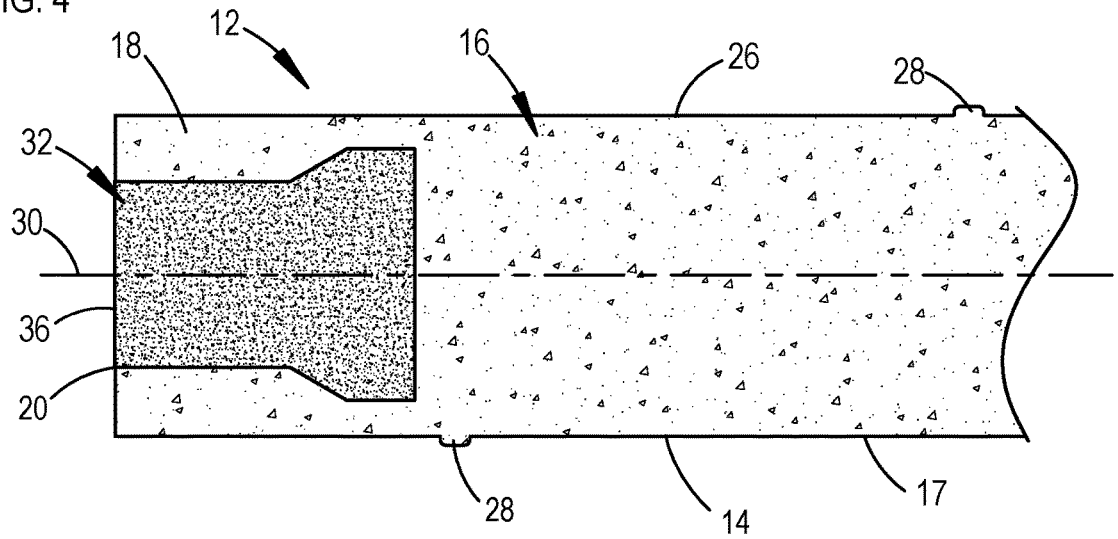

The periphery 26 includes a rib 28 which preferably protrudes radially outward from the lateral portion 17 of the exterior 14 in a spiral pattern for the full length of the power charge 12. The exterior 14 of the propellant 16, the periphery 26 of the power charge 12, and the rib 28 are preferably concentric with the longitudinal axis 30 of the power charge 12. The rib 28 has a cross-section which is of a generally rectangular shape, when taken in sectioning plane at a right angle to the longitudinal axis 30 as shown in FIG. 4. An igniter 32 is preferably embedded in the propellant 16 and located in the first end 18 of the power charge 12, prior to curing of the epoxy binder in the propellant 16. The igniter 32 is preferably centered in the end face 20 of the propellant 16 and disposed in concentric alignment with the exterior 14, the spiral rib 28 and the longitudinal axis 30.

Figure 2:
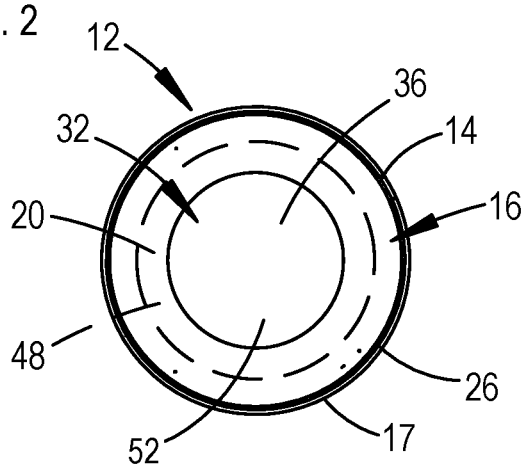

FIG. 2 is an end view of the power charge 12 showing the end face 20. The igniter 32 is preferably centered in the end face 20 and has an end face 36 which is exposed to the environment located outward of the power charge 12. That is, the end face 36 is preferably not covered but instead is fully and completely exposed. Preferably both the periphery 26 and the igniter 32 are concentrically disposed about a central longitudinal axis 30. The lateral periphery 26 may be seen with the exterior 14 of the propellant having the rib 28 protruding outward of the lateral portion 17 in the spiral pattern shown in FIG. 1. The exterior 14 of the propellant 16 includes the first end face 20, the second end face 24, and the periphery 26. The periphery 26 includes the lateral portion 17 and the exterior surfaces of the rib 28.

Figure 3:
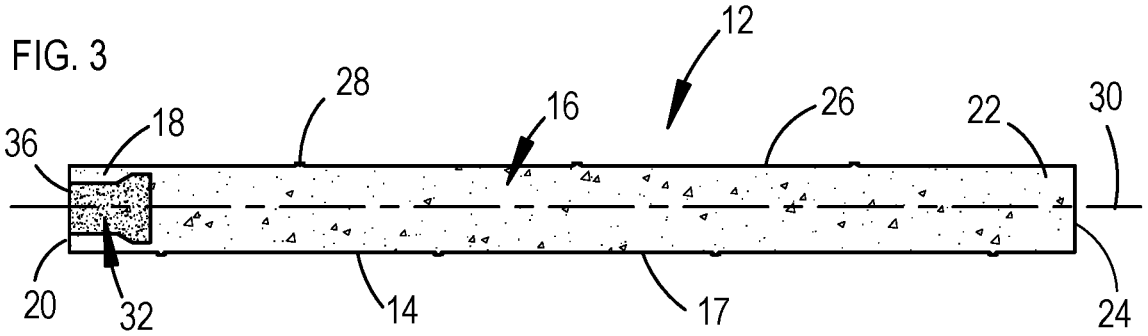

FIG. 3 is a longitudinal section view of the power charge 12, taken along section line 3-3 of FIG. 1, and FIG. 4 is an enlarged, partial section view of the power charge 12, also taken along section line 3-3 of FIG. 1. An end face 36 of the igniter 32 is shown as preferably being centered in the end face 20 of the power charge 12. The end face 36 of the igniter 32 is preferably exposed at the first end 18 of the power charge 21, allowing one or more electrical contact pins of a firing head to directly contact the igniter 32. The igniter 32 can be seen having an annular-shaped protrusion 48 for retaining the igniter 32 within the propellant 16.

Figure 5:
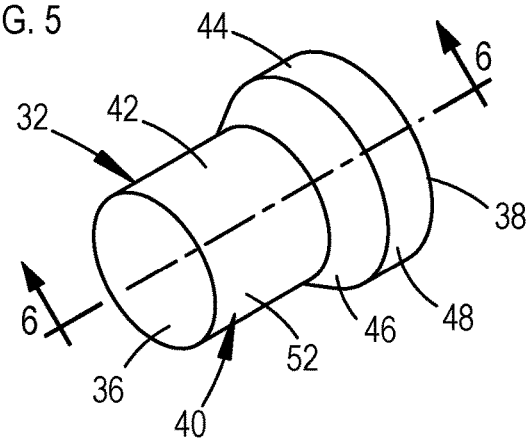
Figure 6:
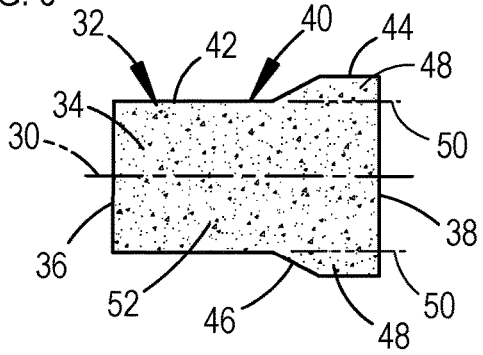

FIG. 5 is perspective view and FIG. 6 is a longitudinal section view, taken along section line 6-6 of FIG. 5, of the igniter 32. The igniter 32 has a first end defining the outward end face 36, a second end defining an inward end face 38, and an external periphery 40. The periphery 40 has a first portion 42 which is preferably cylindrical in shape, a second portion 44 which is also preferably cylindrically shaped, and an intermediate portion defining an annularly extending, frusto-conical shaped shoulder 46 which extends between the first portion 42 and the second portion 44. In this configuration for the igniter 32, the first portion 42 defines at least part of an outer periphery for a main body portion 52 of the igniter 32. The second portion 44 is of a larger size than the first portion 42, such that an annular-shaped protrusion 48 extends laterally outward from projection lines 50. The projection lines 50 are preferably defined by a cylindrical projection from the outer periphery of the first portion 42.

The igniter 32 preferably has a main body portion 52, or a central core portion, which is defined by the first portion 42 of the outer periphery 40 and the projection lines 50 which extend from the first portion. The main body portion 52 does not include the annular-shaped protrusion 48, which is defined to extend between the second peripheral portion 44 of the outer periphery 40 and the projection line 50 extending from the first peripheral portion 42, parallel to the first peripheral portion 42. The opposite terminal ends of the annular-shaped protrusion 48 are defined by the tapered, frusto-conical shaped shoulder 46 and the outward portions of the inward face 38. The annular-shaped protrusion 48 provides a protrusion member which extends laterally outward, or in the case of cylindrically-shaped forms of the igniter 32 extends radially outward, from the main body portion 52 of the igniter 32. The tapered shoulder 46 of the protrusion 48 is spaced apart from the end face 20 of the power charge 12, preferably by a longitudinal length of the periphery 42 which extends parallel to the central axis 30, to provide a layer of the cured propellant 16 between the protrusion 48 and the end face 20 to retain the igniter within the propellant 16 defining the first end 18 of the power charge 12 after curing to form a continuous mass of solid form.

In some embodiments, the annular-shaped protrusion 48 may not be continuous, but may instead be of a castellated shape with a plurality of radially extending projections. In other embodiments, a protrusion member may be provided by one or more radial projections extending in only one or in more radial directions from the central axis 30 of the main body portion 52. The shoulder 46 holds the igniter 32 in place within the power charge and provides a taper. The taper provided by the shoulder 46 has been found to cause the igniter flame to swirl around the main body 52, causing improved ignition of the propellant 16. Improved ignition of the propellant 16 provides for a cleaner burn. Other embodiments of the power charge 12 and the igniter 32 may be formed of various shapes. The power charge 12 and the igniter 32 need not be of cylindrical external shapes, but instead may have cross-sectional shapes which are triangular, oval, square, hexagonal, and the like. Similarly, the outer shapes of the power charge 12 and the igniter 32 may be different from one another. The peripheral exterior shapes of the power charge 12 and the igniter 32 need not be continuous and may also vary in shape from one end to another.

Figure 7:
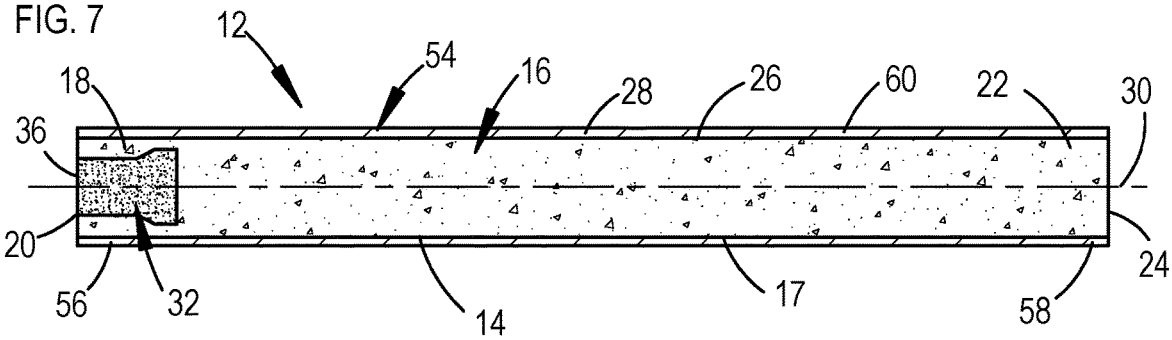

FIG. 7 is a longitudinal section view of the power charge 12 during fabrication, as would be seen if taken along section line 3-3 of FIG. 1. The power charge 12 is preferably formed according to a process using a packing sleeve 54 of tubular shape having a first end 56 and a second end 58. Preferably, the packing sleeve 54 has a cylindrical shaped body 60. Packing sleeves of tubular shapes other than cylindrical may be used, or in the alternative clam-shell type molds rather than tubular sleeves. The mixture providing the propellant 16 is then tightly packed into the packing sleeve 54. An igniter 32 is then preferably embedded in the propellant 16, located in the first end 56 of the packing sleeve 54, prior to curing of the epoxy binder in the propellant 16. The igniter 32 is preferably centered in the first end 56 of the packing sleeve 54, to center the igniter in the end face 20 of the power charge 12, concentrically disposed about the central longitudinal axis 30. The packing sleeve 54 is preferably formed of a paper type fiberboard material, around a mandrel using three to four layers of a sheet of fiberboard material, wound to three or four layers, forming a three ply or four ply tube structure. The interior windings are spaced apart to provide the protuberant rib 28, which is molded of the propellant mixture to provide the propellant 16 as a continuous mass of combustible materials which is cured into a solid form having an exterior 14 which defines the outer periphery 26 of the power charge 12. Thus, power charge 12 is molded into solid form such that the outer periphery 26 of the power charge 12 as defined by the exterior 14 of the continuous mass of the propellent 16 in the shape of the interior profile of the packing sleeve 54.

The propellant 16 of the power charge 12 is a mixture of combustible materials, an oxidizer, and a binder which are cured into a continuous mass of solid form. The binder is preferably a two part epoxy. The propellant 16 is formed of a mixture of elements which provide a controlled burn rate when ignited, such as a burn rate lasting approximately thirty seconds. The elements providing the propellant are a combination of combustible components and an oxidizer. Applicant's present propellant 16 for power charges 12 is typically a mixture including sodium nitrate, Pyrodex, which is a smokeless black powder substitute, and wheat flour. The binder is provided by a two part epoxy composed of an epoxy resin and an epoxy hardner. The propellant mixture 16 is preferably mixed to a dough-like form, of a consistency similar to cookie dough, which is preferably tightly packed and molded into a continuous form, and then cured to provide the solid mass of the propellant 16. A slow cure epoxy is preferably used as the binder which will harden to a solid in twenty-four hours, locking the mixture of the propellant 16 into the rigid, continuous mass of solid form having the exterior 14.

The igniter 32 used for the power charge 12 is preferably formed of an ignition material 34 which includes sixty to seventy percent Pyrodex, which is a smokeless black powder substitute, ten percent potassium nitrate, three percent graphite, carbon black, and a binder, which are packed together with the binder to form a rigid unit. Preferably, the two part epoxy used as a binder for the power charge propellant is used as a binder for the ignition materials 34 of the igniter 32.

Power charges made according to the present invention can be of various sizes, ranging from three-quarter inch diameter to 3 inch diameter, with lengths from eight inches to thirty-eight inches. The largest power charge the applicant currently offers is for a two and eleven-sixteenth inch diameter setting tool, has eight hundred grams of propellant, is eighteen inches long, and has a diameter of two and one-eighth inches. The smallest power charge the applicant currently offers is for a Number Ten setting tool, and has three hundred and sixty grams of propellant, is twelve inches long, and has a diameter of 1.3 inches. The applicant also currently provides a power charge for a Number Twenty setting tool, which has four hundred and sixty grams of propellant, is 11.4 inches long, and has a diameter of 1.5 inches.

The present invention provides advantages of a power charge made fully of the combustible materials used for providing the propellant charge. The propellant is provided by a combination of combustible components and an oxidizer which provided a controlled burn rate to power a downhole setting tool. The propellant is mixed with a binder to provide a mixture which is cured into a solid mass of rigid form, molded into a desired shape for the power charge. Preferably the shape has a protuberant rib which extends from the exterior of the power charge along the length of the power charge in a spiral pattern to provide a standoff from the walls of the power charge chambers for the downhole setting tools. The exterior of the propellant is exposed to provide the outer surface of the power charge. The power charge also includes an igniter embedded in the propellant material of the power charge, which has a laterally outward protruding, annular-shaped protrusion. The annular-shaped protrusion provides a projection which retains the igniter embedded in the propellant packed into the end of a power charge. The annular-shaped, tapered shoulder of the igniter causes the igniter flame to swirl around the main body of the power charge, causing improved ignition of the propellant for a more thorough burn.

Although the preferred embodiment has been described in detail, it should be understood that various changes, substitutions and alterations can be made therein without departing from the spirit and scope of the invention as defined by the appended claims.

What is claimed is:

1. A power charge for igniting in a downhole tool to provide high pressure gas for powering the downhole tool, the power charge comprising:

said power charge having a length, a first end and a second end separated by said length, and an outer periphery, with said outer periphery including a lateral portion which extends along said length to define a lateral periphery;

a propellant which is a mixture of a combustible material, an oxidizer and a binder which is combusted to provide a controlled burn rate to power the downhole tool;

wherein said mixture is substantially homogeneous and cured to bind said mixture in a continuous mass of solid form;

said continuous mass of solid form of said propellant having an exterior which is exposed to thereby provide said lateral periphery of said power charge; and wherein said exterior of said propellant includes a protuberant rib which is formed of said mixture and included as part of said continuous mass of solid form.

2. The power charge according to claim 1, wherein said lateral portion of said periphery defined by said exterior of said propellant is cylindrically shaped.

3. The power charge according to claim 1, wherein said binder comprises a two part epoxy.

4. The power charge according to claim 1, wherein said protuberant rib extends in a spiral pattern from said lateral periphery along said length of said power charge.

5. The power charge according to claim 1, an igniter is disposed in said first end face of said power charge, embedded into said propellant.

6. The power charge according to claim 5, wherein an outward face of said igniter is disposed substantially flush with said end face of said power charge and said end face is provided by said propellant.

7. The power charge according to claim 1, wherein said continuous mass of solid form of said propellant has an exterior which is fully and completely exposed to thereby provide said lateral periphery, said first end and said second end of said power charge.

8. The power charge according to claim 7, wherein said lateral portion of said periphery defined by exterior of said propellant is cylindrically shaped.

9. The power charge according to claim 8, wherein said protuberant rib extends in a spiral pattern from said lateral portion of said periphery along said length of said power charge.

10. The power charge according to claim 7, an igniter is disposed in said first end of said power charge, embedded said propellant.

11. The power charge according to claim 10, wherein an outward face of said igniter is disposed substantially flush with said end face of said power charge and said end face is provided by said propellant.

* * * * *